United States Patent [19]

Horodysky et al.

[11] Patent Number: 4,556,497

[45] Date of Patent: Dec. 3, 1985

[54] N-ALKOXYALKYLENEDIAMINE DIAMIDES AND LUBRICANTS CONTAINING SAME

[75] Inventors: Andrew G. Horodysky, Cherry Hill; Robert M. Gemmill, Jr., Pitman, both of N.J.

[73] Assignee: Mobil Oil Corporation, New York, N.Y.

[21] Appl. No.: 508,979

[22] Filed: Jun. 29, 1983

[51] Int. Cl.[4] ..... C10M 1/36

[52] U.S. Cl. ..... 252/51.5 A; 564/159; 252/401

[58] Field of Search ..... 252/51.5 A, 401; 564/159

[56] References Cited

U.S. PATENT DOCUMENTS

| | | | |
|---|---|---|---|
| 3,259,578 | 7/1966 | Dickson et al. | 252/51.5 A X |
| 3,359,202 | 12/1967 | Stambaugh | 252/51.5 A X |
| 3,501,405 | 3/1970 | Willette | 252/51.5 A |
| 3,778,372 | 12/1973 | Murphy | 252/51.5 A |
| 3,806,456 | 4/1974 | Vogel | 252/51.5 A |
| 4,049,716 | 9/1977 | Collet | 252/51.5 A X |
| 4,329,240 | 5/1982 | Lilburn | 252/51.5 A |
| 4,409,000 | 10/1983 | LeSuer | 252/51.5 A |

*Primary Examiner*—Jacqueline V. Howard
*Attorney, Agent, or Firm*—Alexander J. McKillop; Michael G. Gilman; Van D. Harrison, Jr.

[57] ABSTRACT

Amides of certain ether diamines are provided. These compounds give excellent results when tested in lubricants as friction reducing additives.

22 Claims, No Drawings

N-ALKOXYALKYLENEDIAMINE DIAMIDES AND LUBRICANTS CONTAINING SAME

BACKGROUND OF THE INVENTION

1. Field of the Invention

The invention relates to lubricant compositions. More particularly, it relates to a group of N-alkoxyalkylenediamine amides and to their use in lubricants as multipurpose additives, i.e., as friction reducers, antioxidants and fuel consumption reducers. The invention is especially concerned with internal combustion engines.

2. Discussion of Related Art

As those skilled in this art know, additives impart special properties to lubricants. They may give the lubricants new properties or they may enhance properties already present. One property all lubricants have in common is the reduction of friction between materials in contact. Nonetheless, the art constantly seeks new materials to enhance such friction properties.

A lubricant, even without additives, when used in an internal combustion engine, for example, will not only reduce friction, but in the process will also reduce consumption of the fuel required to run it. When oils appeared to be inexhaustable, and cheap, minimum attention was given to developing additives for the specific purpose of enhancing frictional properties. Instead, most of the advances in this area came as a result of additives being placed in lubricants for other purposes. However, recent events have spurred research programs designed specifically to find materials capable of enhancing the ability of a lubricant to reduce friction.

We have in our work found that there is no dependable correlation between friction reducing properties of an additive and its ability to correspondingly further reduce fuel consumption in an engine. Further, one cannot predict with absolute certainty from the ability of an additive to reduce friction that it will also act to decreae fuel consumption. Thus, even though the use of amides in lubricants is known (see U.S. Pat. No. 3,884,822, for example, which discloses lubricants containing the product of reaction between an aminopyridine and oleic acid), no art teaches or suggests that the amides of this invention are useful for the purposes disclosed herein.

SUMMARY OF THE INVENTION

In accordance with the invention, there is provided a lubricant or liquid fuel composition comprising a major proportion of a lubricant or fuel and a friction reading, a fuel consumption reducing or an antioxidant amount of an N-alkoxyalkylenediamine amide of the formula

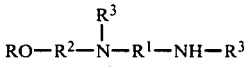

wherein R is a hydrocarbyl group containing 6 to 20 carbon atoms, $R^1$ and $R^2$ are $C_2$ to $C_3$ hydrocarbylene groups and $R^3$ is hydrogen or

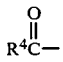

where $R^4$ preferably is hydrogen, or is a $C_1$ to $C_3$ alkyl group, at least one of the $R^3$ groups being the latter. It will be understood that "hydrocarbyl" and "hydrocarbylene" preferably refer to alkyl and alkylene groups.

Some cyclized by-products of the N-alkylalkylenediamine amides can also be formed during manufacture, but do not appear to detract from the friction properties. In fact, they may actually be beneficial to the total properties of the finished lubricant or fuel.

The invention provides the compounds also.

DESCRIPTION OF SPECIFIC EMBODIMENTS

The diamine amides can be made by any method known to the art. In general, they can be made by reacting an N-alkylalkylenediamine of the formula

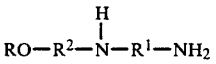

with an acid of the formula

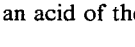

wherein R, $R^1$, $R^2$, $R^3$ and $R^4$ are as hereinabove described and $R^5$ is the same as $R^4$.

The general reaction conditions are not critical. Reaction can take place between the diamine and the acid at a temperature of between about 80° C. and about 260° C., preferably about 120° C. to about 160° C. The reaction will usually be completed in from 2 to 10, but where the reactants demand it, up to 24 hours may be required for reaction completion.

Hydrocarbon solvents, or other inert solvents may be used in the reaction. Included among the useful solvents are benzene, toluene and xylene. In general, any hydrocarbon solvent can be used in which the reactants are soluble and which can, if the products are soluble therein, be easily removed.

In carrying out the reaction, the molar ratio of ether diamine to acid can range from about 10:1 to about 1:2, but preferably will range from about 1:1 to about 1:2.

Some useful diamines include hexoxypropyl-1,3-propylenediamine, heptoxypropyl-1,3-propylenediamine, octoxypropyl-1,3-propylenediamine, nonoxypropyl-1,3-propylenediamine, decoxypropyl-1,3-propylenediamine, dodecoxypropyl-1,3-propylenediamine, tetramethylnonoxypropyl-1,3-propylenediamine, pentadecoxypropyl-1,3-propylenediamine, stearyloxypropyl-1,3-propylenediamine, cocooxypropyl-1,3-propylenediamine and mixtures of two or more of these. Mixtures are often more preferred than the individual diamine. It will be noted that all the R groups included in these listed diamines are alkyl or alkenyl groups. Compounds containing other hydrocarbyl groups, such as aryl groups, alkaryl groups, aralkyl groups or cycloalkyl group may also be used.

While the reaction outlined is the usual, and preferred one, other reactions may be used to prepare the diamine amides. For example, formate esters can be reacted with the etherdiamines to produce etherdiamine amides as defined above by ammonolysis of such esters. For instance, methyl formate can be reacted with the etherdiamine to form etherdiamine formamides. The reaction is generally exothermic and proceeds at temperatures of from about 50° C. to about 125° C. Ratios of reactants, i.e., etherdiamine and formate ester, may be from about 10:1 to about 1:2, preferably about 1:1 to about 1:2.

An important feature of the invention is the ability of the additive to improve the resistance to oxidation of oleaginous materials such as lubricating oils, either a mineral oil or a synthetic oil, or mixtures thereof, or a grease in which any of the aforementioned oils are employed as a vehicle. In general, mineral oils, both paraffinic, naphthenic and mixtures thereof, employed as a lubricating oil or as the grease vehicle, may be of any suitable lubricating viscosity range, as for example, from about 45 SSR at 100° F. to about 6000 SSU at 100° F., and preferably from about 50 to about 250 SSR at 210° F. These oils may have viscosity indexes ranging to about 100 or higher. Viscosity indexes from about 70 to about 95 are preferred. The average molecular weights of these oils may range from about 250 to about 800. Where the lubricant is to be employed in the form of a grease, the lubricating oil is generally employed in an amount sufficent to balance the total grease composition, after accounting for the desired quantity of the thickening agent, and other additive components to be included in the grease formulation. A wide variety of materials may be employed as thickening or gelling agents. These may include any of the conventional metal salts or soaps, which are dispersed in the lubricating vehicle in grease-forming quantities in an amount to impart to the resulting grease composition the desired consistency. Other thickening agents that may be employed in the grease formulation may comprise the non-soap thickeners, such as surface-modified clays and silicas, aryl ureas, calcium complexes and similar materials. In general, grease thickeners may be employed which do not melt and dissolve when used at the required temperature within a particular environment; however, in all other respects, any material which is normally employed for thickening or gelling hydrocarbon fluids for forming grease can be used in preparing the aforementioned improved grease in accordance with the present invention.

In instances where synthetic oils, or synthetic oils employed as the vehicle for the grease, are desired in preference to mineral oils, or in preference to mixtures of mineral and synthetic oils, various synthetic oils may be successfully utilized. Typical synthetic vehicles include polyisobutylenes, polybutenes, hydrogenated polydecenes, polypropylene glycol, polyethylene glycol, trimethylol propane esters, neopentyl and pentaerythritol esters, di(2-ethylhexyl)sebacate, di(2-ethylhexyl)adipate, dibutyl phthalate, fluorocarbons, silicate esters, silanes, esters of phosphorus-containing acids, liquid ureas, ferrocene derivatives, hydrogenated synthetic oils, chain-type polyphenyls, siloxanes and silicones (polysiloxanes) and alkyl-substituted diphenyl ethers typified by a butyl-substituted bis(p-phenoxy phenyl)ether, phenoxy phenylethers.

It is to be understood that the compositions contemplated herein can also contain other materials. For example, other corrosion inhibitors, extreme pressure agents, viscosity index improvers, coantioxidants, antiwear agents and the like can be used. These include, but are not limited to, phenates, sulfonates, succinimides, zinc dialkyl dithiophosphates, and the like. These materials do not detract from the value of the compositions of this invention; rather the materials serve to impart their customary properties to the particular compositions in which they are incorporated.

Mineral oil heat exchange fluids particularly contemplated in accordance with the present invention have the following characteristics: high thermal stability, high initial boiling point, low viscosity, high heat-carrying ability and low corrosion tendency.

Further, the transmission fluids of consequence to the present invention are blends of highly refined petroleum base oils combined with VI improvers, detergents, defoamants and special additives to provide controlled-friction or lubricity characteristics. Varied transmission design concepts have led to the need for fluids with markedly different frictional characteristics, so that a single fluid cannot satisfy all requirements. The fluids intended for use in passenger car and light-duty truck automatic transmissions are defined in the ASTM Research Report D-2; RR 1005 on "Automatic Transmission Fluid/Power Transmission Fluid Property and Performance Definitions. Specifications for low-temperature and aircraft fluids are defined in U.S. Government Specification MIL-H-5606A.

In addition, the oxidation and corrosion resistance of functional fluids such as hydraulic fluids can be improved by the adducts of the present invention.

The products of this invention can also be employed in liquid hydrocarbon fuels, alcohol fuels or mixtures thereof, including mixtures of hydrocarbons, mixtures of alcohols and mixtures of hydrocarbon and alcohol fuels. About 25 pounds to about 500 pounds or preferably about 50 to 100 pounds of etherdiamine amide per thousand barrels of fuel for internal combusion engines may be used. Liquid hydrocarbon fuels include gasoline, fuel oils and diesel oils. Methyl and ethyl alcohols are examples of alcohol fuels.

In general, the reaction products of the present invention may be employed in any amount which is effective for imparting the desired degree of friction reduction or antioxidant activity. In these applications, the product is effectively employed in amounts from about 0.1% to about 10% by weight, and preferably from about 1% to about 5% of the total weight of the composition.

The following Examples will present illustrations of the invention. They are illustrative only, and are not meant to limit the invention.

EXAMPLE 1

DIFORMAMIDE OF N-MIXED DODECOXY-PENTADECOXYPROPYL-1,3-PROPYLENEDIAMINE

Approximately 48 g of N-mixed dodecoxy-pentadecoxypropyl-1,3-propylenediamine (commercially obtained as Armak Chemical Company's Duomeen EA-25 etherdiamine) containing approximately 20% $C_{12}$, ~30% $C_{13}$, ~30% $C_{14}$, 20% $C_{15}$, 1% or less $C_{11}$ and lower and 1% or less $C_{16}$ and higher and approximately 40 g of toluene were charged to a 250 ml stirred reactor equipped with a Dean-Stark condensing trap. Approximately 18 g of 88% formic acid were added with agitation and a nitrogen purge of the vapor space was started. The mixture was heated to 175° C. for a period of 6 hours until water evolution during azeotropic distillation ceased. The unreacted starting materials and solvent were removed by vacuum distillation and the product was filtered through diatomaceous earth at approximately 100° C.

EXAMPLE 2

FORMAMIDE OF N-TETRAMETHYLNONYLOXYPROPYL-1,3-PROPYLENEDIAMINE

Approximately 160 g of tetramethylnonyloxypropyl-1,3-propylene-diamine (obtained as Duomeen EA-13 from Armak Chemical Co.), 75 g of toluene and 26 g of 88% formic acid were reacted as described in Example 1. The mixture was heated up to 155° C. for 4.5 hours until water evolution during azeotropic distillation ceased. The unreacted starting materials and solvent were removed by vaccum distillation and the product was filtered through diatomaceous earth at approximately 100° C.

EXAMPLE 3

FORMAMIDE OF N-MIXED HEXOXY-DECOXYPROPYL-1,3-PROPYLENEDIAMINE

Approximately 40 g of N-mixed hexoxy-decoxypropyl-1,3-propylene-diamine (obtained commercially as Armak Chemical Co. Duomeen EA-80, containing 5% $C_6$, 56% $C_8$ and 39% $C_{10}$), 13 g of 88% formic acid and 60 g of toluene were reacted as described in Example 1. The mixture was heated up to 180° C. for about 6 hours until water evolution during azeotropic distillation ceased. The unreacted starting materials and solvent were removed by vacuum distillation and the product was filtered through diatomaceous earth.

EXAMPLE 4

FORMAMIDE OF N-MIXED DODECOXY-PENTADECOXYPROPYL-1,3-PROPYLENEDIAMINE

Approximately 26 g of N-mixed dodecoxy-pentadecoxypropyl-1,3-propylenediamine (Duomeen EA-25 etherdiamine of Example 1), 25 g of toluene and 6.5 g of 88% formic acid were reacted as generally described in Example 1. The mixture was heated up to 175° C. for 5 hours until water evolution during azeotropic distillation ceased. The unreacted starting materials and solvent were removed by vacuum distillation and the product was filtered through diatomaceous earth at approximately 100° C.

EVALUATION OF THE COMPOUNDS

The compounds were evaluated in a Low Velocity Friction Apparatus (LVFA) in a fully formulated mineral or synthetic, automotive engine oil containing an additive package including antioxidant, dispersant and detergent.

Description

The Low Velocity Friction Apparatus (LVFA) is used to measure the coefficient of friction of test lubricants under various loads, temperatures, and sliding speeds. THE LVFA consists of a flat SAE 1020 steel surface (diameter 1.5 in.) which is attached to a drive shaft and rotated over a stationary, raised, narrow ringed SAE 1020 steel surface (area 0.08 in.$^2$). Both surfaces are submerged in the test lubricant. Friction between the steel surfaces is measured as a function of the sliding speed at a lubricant temperature of 250° F. The friction between the rubbing surfaces is measured using a torque arm-strain gauge system. The strain gauge output, which is calibrated to be equal to the coefficient of friction, is fed to the Y axis of an X-Y plotter. The speed signal from the tachometer-generator is fed to the X-axis. To minimize external friction, the piston is supported by an air bearing. The normal force loading the rubbing surfaces is regulated by air pressure on the bottom of the piston. The drive system consists of an infinitely variable-speed hydraulic transmission driven by a ½ HP electric motor. To vary the sliding speed, the output speed of the transmission is regulated by a lever-cammotor arrangement.

Procedure

The rubbing surfaces and 12–13 ml of test lubricants are placed on the LVFA. A 240 psi load is applied and the sliding speed is maintained at 40 fpm at ambient temperature for a few minutes. A plot for coefficients of friction ($U_k$) vs. speed were taken at 240, 300, 400, and 500 psi. Freshly polished steel specimens are used for each run. The surface of the steel is parallel ground for 4 to 8 microinches. The results in Table 1 refer to percent reduction in friction compared to the unmodified oil. That is, the formulation mentioned above was tested without the compound of this invention and this became the basis for comparison. The results were obtained at 250° F. and 500 psi.

TABLE 1

EVALUATION OF FRICTION REDUCING CHARACTERISTICS

| Medium and Additive | Additive Conc. Wt. % | % Reduction in Coefficient of Friction 5 Ft./Min. | 30 Ft./Min. |
|---|---|---|---|
| Base Oil A* | — | 0 | 0 |
| Example 1 (1) | 2 | 33 | 30 |
| | 1 | 29 | 29 |
| | 0.5 | 19 | 19 |
| Base Oil B** | — | 0 | 0 |
| Example 1 (2) | 3 | 23 | 26 |
| Example 2 (2) | 2 | 11 | 16 |
| Example 3 (2) | 2 | 19 | 21 |
| Example 4 (2) | 2 | 16 | 18 |

*Fully formulated SAE 10W/40 100 second paraffinic neutral mineral oil containing other additives as mentioned herein.
**Fully formulated synthetic oil (5W30) containing detergent/dispersant/inhibitor package.
(1) - In oil A.
(2) - In oil B.

The coefficients of friction were significantly reduced relative to the base oil with reductions being somewhat greater in the mineral oil lubricant formulations. Significant reductions in the coefficients of friction were noted with the use of only 1% of Example 1 admixed into a fully formualted lubricant containing detergent/dispersant/inhibitor/viscosity index improving additive package. Lower concentrations of less than 1% are also expected to contribute significantly to reductions in friction.

CATALYTIC OXIDATION TEST

The oxidation tests comprised adding the product to 200″ solvent paraffin neutral mineral oil. The composition subjected to an air stream at 10 liters per hour, while the oil sample was maintained at 325° F. for 40 hours. Also present in the sample were samples of the usual metals of construction, i.e., iron, copper, aluminum and lead. The compositions were evaluated for any change in acidity and viscosity. A decrease in either or both of these indicates an effective additive.

TABLE II

CATALYTIC OXIDATION TEST

| | Additive Conc. Wt. % | % Increase in Viscosity of Oxidized Oil KV @ 210° F. | Neut. Number NN |
|---|---|---|---|
| Base Oil | — | 67 | 3.62 |
| Example 1 | 3 | 7 | 0.44 |
| | 1 | 33 | 3.07 |
| Example 2 | 3 | 11 | 0.27 |
| | 1 | 31 | 3.04 |

TABLE II-continued

| CATALYTIC OXIDATION TEST | | | |
|---|---|---|---|
| | Additive Conc. Wt. % | % Increase in Viscosity of Oxidized Oil KV @ 210° F. | Neut. Number NN |
| Example 4 | 0.5 | 20 | 2.85 |

We claim:

1. The product of the formula

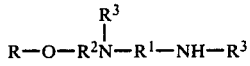

wherein R is a hydrocarbyl group containing from 6 to 20 carbon atoms, $R^1$ and $R^2$ are $C_2$ to $C_3$ hydrocarbylene groups and $R^3$ is hydrogen or

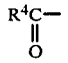

wherein $R^4$ is hydrogen or a $C_1$ to $C_3$ alkyl group, at least one of the $R^3$ groups being the latter.

2. The product of claim 1, wherein R is an alkyl, aryl, aralkyl, alkaryl or cycloalkyl group.

3. The product of claim 2 wherein R, $R^1$ and $R^2$ are alkyl groups.

4. The product of claim 1 wherein $R^4$ is hydrogen.

5. The product of claim 3 wherein R is a hexyl, heptyl, octyl, nonyl, decyl, dodecyl, tetramethylnonyl, or mixtures thereof.

6. The product of claim 1 having the formula

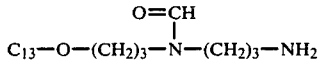

or

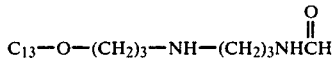

wherein $C_{13}$ is the tetramethylnonyl group.

7. A lubricant composition comprising a major proportion of a lubricating oil or grease therefrom and a friction reducing amount of the compound of the formula:

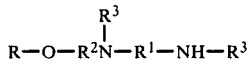

wherein R is a hydrocarbyl group containing from 6 to 20 carbon atoms, $R^1$ and $R^2$ are $C_2$ to $C_3$ hydrocarbylene groups and $R^3$ is hydrogen or

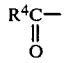

wherein $R^4$ is hydrogen or a $C_1$ to $C_3$ alkyl group, at least one of the $R^3$ groups being the latter.

8. The composition of claim 7 wherein R is an alkyl, aryl, aralkyl, alkaryl or cycloalkyl group.

9. The composition of claim 8 wherein R, $R^1$ and $R^2$ are alkyl groups.

10. The composition of claim 7 wherein $R^4$ is hydrogen.

11. The composition of claim 9 wherein R is a hexyl, heptyl, octyl, nonyl, decyl, dodecyl, tetramethylnonyl, or mixtures thereof.

12. The composition of claim 7 wherein the lubricant is a grease.

13. The composition of claim 7 wherein the lubricating oil is (1) a mineral oil, (2) a synthetic oil or mixture thereof, (3) a mixture of mineral oil and the synthetic oils of (2).

14. The composition of claim 13 wherein the oil is a mineral oil.

15. The composition of claim 13 wherein the oil is a synthetic oil.

16. The product of claim 1 having the formula

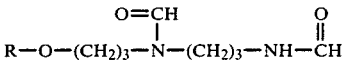

wherein R ranges from dodecyl to pentadecyl groups.

17. The product of claim 1 comprising a mixture of compounds of the formulas

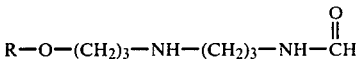

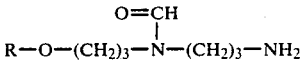

and

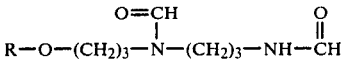

wherein the R ranges from hexyl to decyl groups.

18. The product of claim 1 comprising a mixture of compounds of the formulas

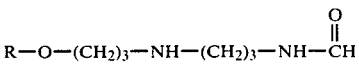

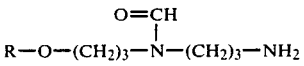

and

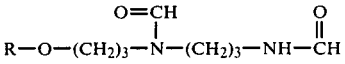

wherein the R ranges from dodecyl to pentadecyl groups.

19. The composition of claim 18 wherein the compound has the formula

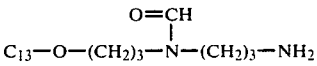

or

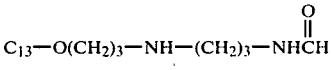

in which $C_{13}$ is the tetramethylnonyl group.

20. The composition of claim 7 wherein the compound has the formula:

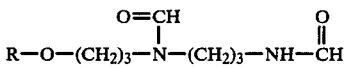

in which the R ranges from dodecyl to pentadecyl groups.

21. The composition of claim 7 wherein the product comprises a mixture of compounds of the formulas

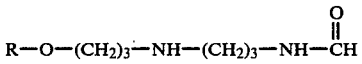

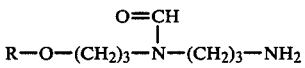

and

-continued

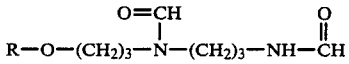

wherein R ranges from hexyl to decyl groups.

22. The composition of claim 7 wherein the product comprises a mixture of compounds of the formulas

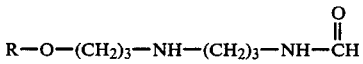

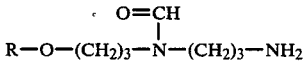

and

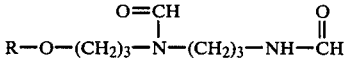

wherein R ranges from dodecyl to pentadecyl groups.

* * * * *